United States Patent [19]

Rettew

[11] 4,262,455

[45] Apr. 21, 1981

[54] HEAD POSITIONING FOR A BELT GRINDER

[75] Inventor: Richard Rettew, Newmanstown, Pa.

[73] Assignee: Contraves Goerz Corporation, Pittsburgh, Pa.

[21] Appl. No.: 936,621

[22] Filed: Aug. 24, 1978

[51] Int. Cl.[3] ..... B24B 21/00

[52] U.S. Cl. ..... 51/142; 51/143; 51/148

[58] Field of Search ..... 51/135 R, 135 BT, 142, 51/143, 148, 170 EB; 74/242.16, 242.8

[56] References Cited

U.S. PATENT DOCUMENTS

| | | | |
|---|---|---|---|
| 1,709,171 | 4/1929 | Holmes | 51/135 R |
| 2,378,066 | 6/1945 | De Young | 51/92 R |
| 2,396,775 | 3/1946 | De Young | 51/92 R |
| 2,837,877 | 6/1958 | Andrus | 51/143 |
| 3,089,287 | 5/1963 | Dilks | 51/35 |
| 3,491,488 | 1/1970 | Schaller et al. | 51/135 R |

*Primary Examiner*—Harold D. Whitehead
*Assistant Examiner*—K. Bradford Adolphson
*Attorney, Agent, or Firm*—Robert D. Yeager

[57] ABSTRACT

A grinding machine wherein the grinding head is positioned on the work piece at a selected pressure to prevent overloading of the drive motor. The head consists of two vertical slides supported on roundway roller bearings from a vertical column. The bottom slide supports a driven contact wheel and the top slide supports an idler wheel. A coated abrasive belt is positioned around the contact wheel and the idler wheel. A pair of pneumatic cylinders are provided between the two slides to bias them apart and apply tension to the coated abrasive belt. A double acting hydraulic cylinder is supported by the vertical column and connected to the bottom slide for positioning the grinding head. Hydraulic pressure for down feeding of the head is regulated so that the drive motor cannot be overloaded. An incremental feed is provided for feeding the head down a selected increment each time the work table reciprocates. An adjustable fixed stop is provided for limiting downward movement of the bottom slide. The fixed stop limits downward travel of the grinding head, however, positioning of the head above the stop is not affected. Thus when the head is raised the position of the fixed stop remains unchanged. A safety lift off is provided to automatically raise the head if the belt tears.

15 Claims, 19 Drawing Figures

HEAD POSITIONING FOR A BELT GRINDER

CROSS REFERENCE TO RELATED APPLICATIONS

This application is related to U.S. patent application Ser. No. 936,349, filed Aug. 24, 1978.

BACKGROUND OF THE INVENTION

1. Field of the Invention

This invention relates to a material removing machine and more particularly to a high speed high pressure belt grinder.

2. Description of the Prior Art

Numerous metal removal apparatus and methods are disclosed in the prior art. Milling machines, vertical spindle grinders, double disc grinders, face broches, and planars have been utilized for removing material from flat planar surfaces. The prior art also includes numerous belt grinding machines for material removal.

U.S. Pat. No. 3,668,814 issued to C. T. Freerks recognizes that with high pressure belt grinder, above a predetermined minimum pressure, metal is removed so swiftly that a large percentage of the heat generated is removed by the chips. This results in a temperature rise of a work piece which is greatly reduced as compared with the temperature rise of the work piece when it is ground at pressures below the predetermined minimum pressure, so that damage to the part and to the abrasive belt is minimized.

It has been recognized that it is desirable to move the grinding belt relative to the work piece for uniform belt wear. This has typically been achieved in the prior art by moving the belt back and forth along the contact and idler pulley. The idler pulley can be shifted to cause this back and forth movement of the grinding belt relative to the contact pulley and idler pulley. I recognized that this type of belt shifting causes premature belt failure since first all the tension is applied to one edge of the belt then the tension is transferred to the other belt edge. This continues as long as the belt is moved back and forth. In my belt grinder I maintain a relatively even tension over the whole belt as compared with other belt tracking systems.

In some prior art grinding machines the work piece is moved upward against the grinding belt by vertical upward movement of the table. This limits the thickness of the work piece. For machines such as this the table is moved by hydraulic cylinders which may introduce inaccuracies as their stroke increases. In my machine the head is moved downward against a vertically fixed table and work piece size is only limited by head clearance.

In other prior art belt grinding machines a cantilevered head is used and this also severely limits workpiece thickness.

The following U.S. Patents are exemplary of prior art belt grinders: (1) U.S. Pat. No. 2,813,382; (2) U.S. Pat. No. 3,132,451; (3) U.S. Pat. No. 3,229,424; (4) U.S. Pat. No. 3,325,947; (5) U.S. Pat. No. 3,394,501; (6) U.S. Pat. No. 3,510,988; (7) U.S. Pat. No, 3,524,285; (8) U.S. Pat. No. 3,739,535; and (9) U.S. Pat. No. 3,908,316.

SUMMARY OF THE INVENTION

The invention discloses a high speed, high pressure coated abrasive belt grinding machine having improved positioning apparatus for the belt grinding head. The pressure with which the grinding head can contact the work piece is regulated to prevent an overload of the drive motor. The grinding head comprises two vertical slides which are biased apart. The two slides are supported from a vertical column. The upper slide supports an idler pulley and the lower slide supports a driven pulley. The driven pulley is a contact wheel which applies pressure against the work piece. A continuous coated abrasive grinding belt is positioned around the contact wheel and the idler wheel. The lower slide also supports the drive motor for movement therewith. The idler pulley is offset from vertical alignment with respect to the contact wheel and is of a smaller outer diameter. The smaller diameter idler pulley causes increased contact between the contact wheel and the coated abrasive belt. Offsetting the idler pulley improves the contact pressure between the contact wheel and grinding belt.

A pair of pneumatic cylinders are provided between the upper slide, which can also be called the idler wheel assembly, and the lower slide, which can also be called the contact wheel assembly, for biasing them apart. As the contact wheel and idler wheel are biased apart tension is applied to the coated abrasive belt. A hydraulic cylinder is provided for moving the contact wheel assembly with respect to the vertical column for controlling the height of the grinding head with respect to the work table. The hydraulic cylinder is used for raising and lowering the grinding head assembly. A hydraulic supply is provided for supplying pressurized hydraulic fluid to the hydraulic cylinder. A reciprocating table for supporting the work piece is disposed beneath the grinding head. The pressure of the hydraulic fluid supplied for moving the grinding head towards the table, and into engagement with the work piece, is regulated to prevent overloading of the drive motor. If the depth of cut selected is too great the grinding head will ride up on the work piece and not overload the drive motor.

Each time the table goes through one cycle it activates a limit switch which causes the grinding head to move down a selected amount. This limit switch activates a timer which energizes a solenoid valve to feed hydraulic fluid to the head positioning cylinder for a selected period of time.

The grinding head is thus fed down on the work piece in adjustable incremental steps.

An adjustable fixed stop is provided for limiting downward movement of the grinding head assembly. The fixed stop thus determines how close the grinding head can approach the table and this limits the amount of material removed from the work piece. The set stop position is not affected by positioning of the grinding head. Thus the grinding head can be raised, for example, to change a belt, and not affect the set stop position.

A stop limit switch is provided to be activated when the grinding head reaches the fixed stop. When this limit switch is activated the table is reciprocated one more time and then the head is raised.

A safety lift off is provided for raising the grinding head automatically if the belt tears. The safety lift off utilizes a position sensor to determine when the position of the idler wheel slide is separated from the contact wheel slide by a distance which is only possible when a belt tear has occurred. When this predetermined separation between the idler wheel slide and the contact wheel slide occurs, the sensor activates, through an appropriate solenoid valve, the hydraulic positioning cylinder to raise the contact wheel slide. The position of the fixed stop can be adjusted either manually or by an electric drive.

It is an object of this invention to teach a high speed, high pressure coated abrasive belt grinding machine wherein the pressure with which the grinding head assembly contacts the work piece is regulated to prevent overload of the drive motor.

It is another object of this invention to teach a grinding machine having a grinding head comprising two vertical slides which are biased apart by a cylinder disposed therebetween.

It is another object of this invention to teach a belt grinding machine having means for determining when the belt breaks to automatically raising the grinding head.

It is yet another object of this invention to teach a belt grinding machine wherein the grinding head assembly is moved down in increments till it contacts a fixed stop whose position is adjustable.

BRIEF DESCRIPTION OF THE DRAWINGS

For a better understanding of the invention, reference may be had to the preferred embodiment exemplary of the invention shown in the accompanying drawings in which.

DETAILED DESCRIPTION OF THE PREFERRED EMBODIMENTS

Figure 1:
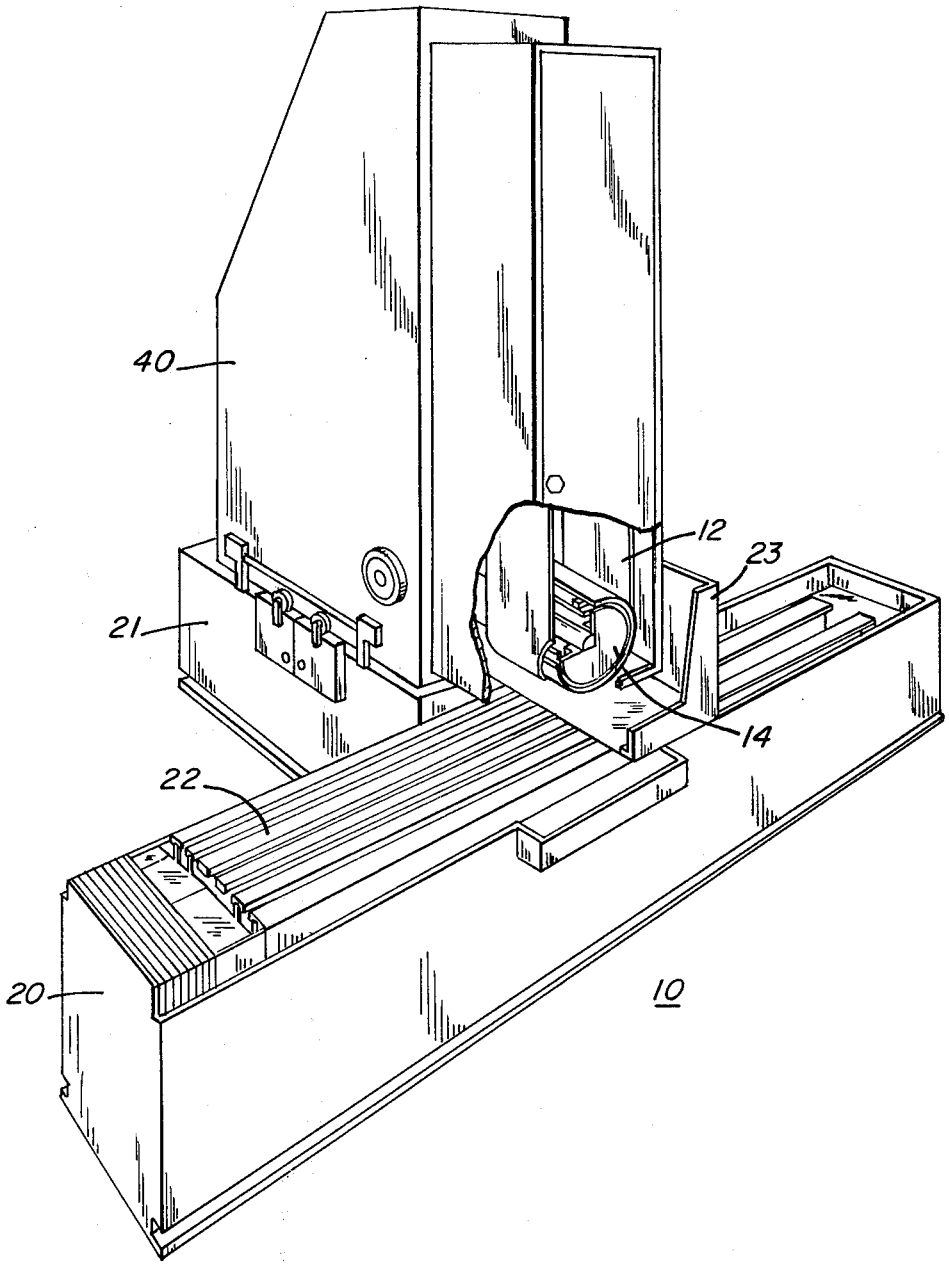
FIG. 1 is a perspective view of a high speed, high pressure belt grinding machine constructed according to the teaching of the present invention.

Referring now to the drawings and FIGS. 1 through 4 in particular there is shown a belt grinding machine 10 constructed according to the teaching of the present invention. The disclosed machine 10 provides coated abrasive machining and utilizes an endless belt 12 covered with a mineral grain to grind planar surfaces. Belt grinding machine 10 provides for high speed, high pressure stock removal. The coated abrasive belt 12 is disposed around a contact wheel 14 and an idler wheel 16. Typical belt speeds for the disclosed grinder 10 are around 8,000 surface feet per minute. No outboard support is required for contact wheel 14. A fixed bed 20 is provided on which a 16 inch by 48 inch reciprocating table 22 is supported on roundway roller bearings. Table 22 is constructed to hold the work piece. A fixed base 21 extends at a right angle from bed 20. A vertical column 40 is slidably supported from base 21. Column 40 oscillates back and forth with respect to reciprocating table 22 along base 21. Reciprocating column 40 moves at a right angle to the longitudinal axis of bed 20 on base 21. Base 21 is securely fastened to bed 20. An optical electrical tracking system is provided for maintaining belt 12 at a fixed location on drive pulley 14 and idler pulley 16. This is unlike most prior art grinding machines on which the belt is purposely caused to oscillate on the drive and idler pulley. In grinding machine 10 belt 12 is maintained at a fixed position on pulleys 14, 16 and, column 40 is oscillated back and forth a selected distance at a selected speed.

The speed and distance of movement of column 40 are variable. Likewise the speed and distance of movement of reciprocating table 22 are variable. The work piece is attached to table 22 and then the contact wheel 14 is lowered so that the coated abrasive belt 12 engages the work piece and removes the desired amount of material. The typical belt speed of approximately 8000 surface feet per minute, coupled with the feed rate of 25 to 35 feet per minute, generates temperatures in the contact area that approach the melting point of the material abraded. These temperatures aid the machining process by reducing friction and correspondingly increase belt life. U.S. Pat. No. 3,668,814, issued to C. T. Freerks pointed out that with high pressure grinding above a predetermined minimum pressure, metal is removed so swiftly that a large percentage of the heat generated is removed with the chips. In my invention any heat build up in the work piece is minimal since typically over 90% of the energy released is removed by the swarf.

Base 21 provides support for column 40. Base 21 encloses column 40 oscillating mechanism. Base 21 is securely fastened to bed 20 by suitable means such as bolting. The disclosed grinding machine 10 is of a modular construction so that various types of bases can be connected to various types of beds to provide for metal removal on a wide variety of products. For example, reciprocating table 22 can be removed and replaced with a through conveying system and multiple columns can be mounted from bed 20. Thus a coarse and fine cut could be made on a single pass of the item through the grinder.

Figure 2:
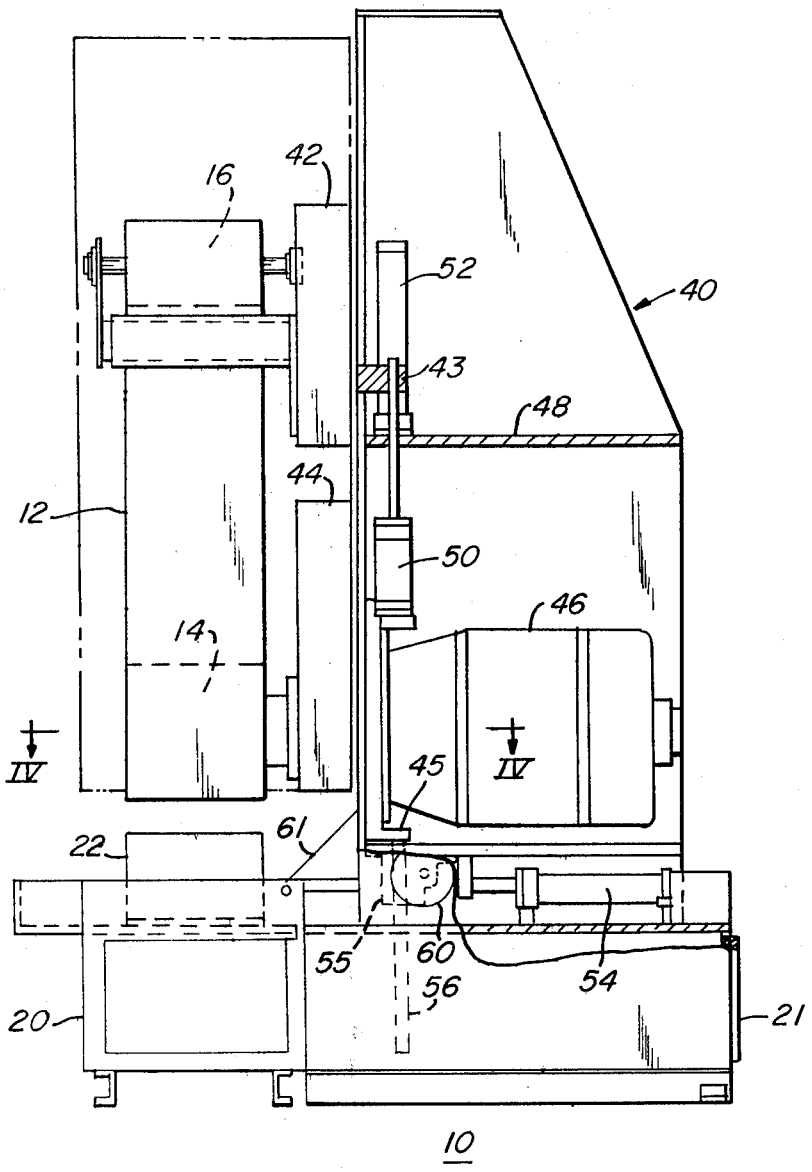
FIG. 2 is an end view of the grinding machine shown in FIG. 1 with certain portions not shown for clarity.
Figure 3:
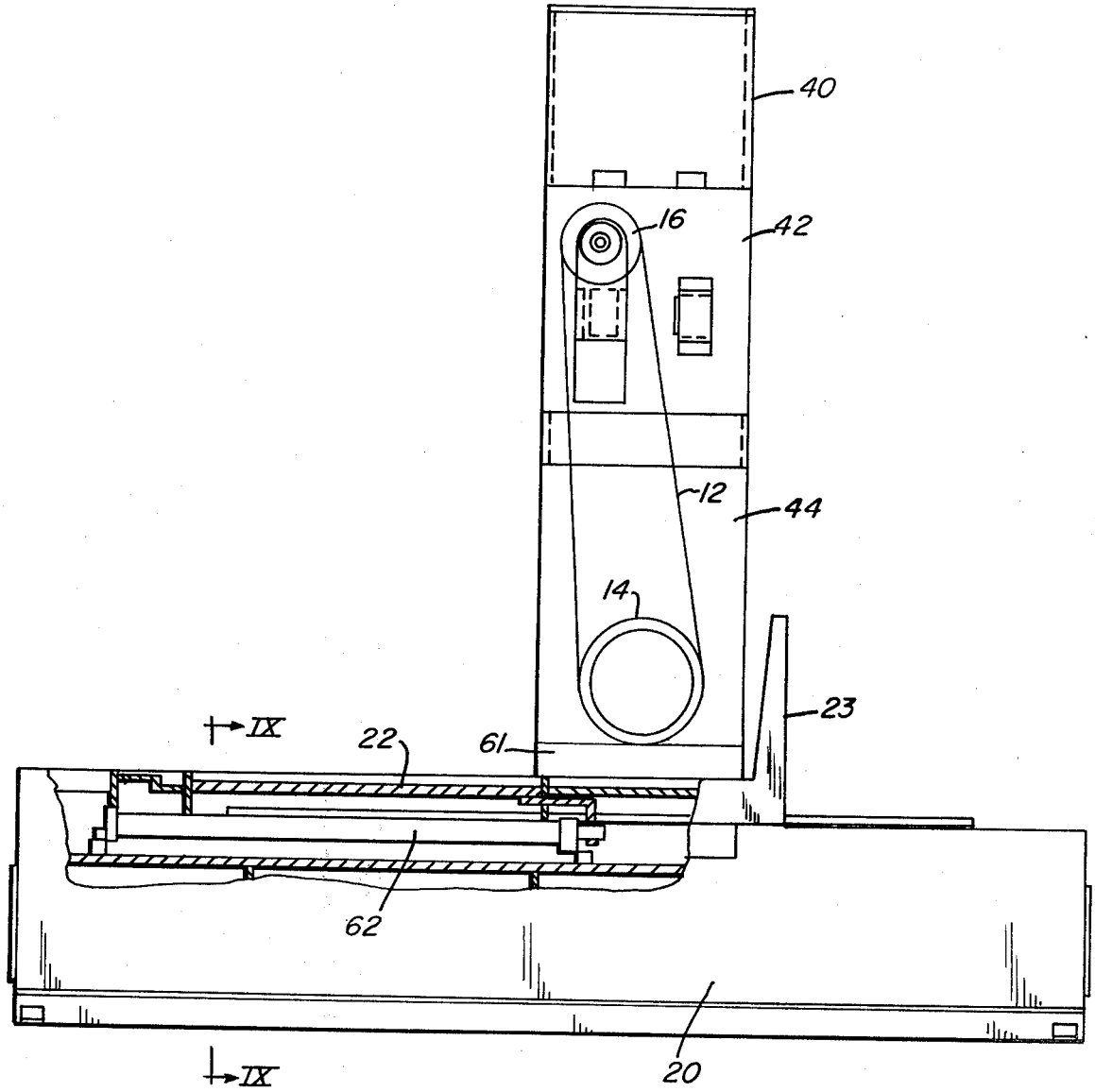
FIG. 3 is a front view of the grinding machine shown in FIG. 1 with portions removed for clarity.

Referring now to FIGS. 2 and 3 there is shown grinding machine 10 constructed according to the present invention with some items deleted or shown schematically for clarity. Column 40, which reciprocates on base 21 and moves belt 12 transverse to table 22, supports the drive assembly for contact wheel 14. An upper slide 42 and a lower slide 44 are slidably supported from vertical column 40. Rollway bearings as manufactured by Thomson Industries, Inc., Manhasset, New York 11030, are utilized for supporting the upper slide 42 and the lower slide 44 from vertical column 40. Contact wheel 14, whose construction will later be described in detail, is direct driven by drive motor 46. In the embodiment shown drive motor 46 is a 125 horse power, 1750 rmp, 3 phase, 60 hertz, 230/460 induction motor. Drive motor 46 is flanged mounted to a rear portion of lower slide 44. Column 40, which is mounted for sliding movement on base 21, is a fabricated steel unit approximately 105 inches in height. Support plate 48 is disposed horizontally within column 40. A pair of pneumatic cylinders 50 are disposed between the upper slide 42 and the lower slide 44. Openings are formed in plate 48 through which the operating rods of pneumatic cylinders 50 extend to connect to rear blocks 43 formed integral with upper slide 42. The pneumatic cylinders 50 bias slides 42, 44 apart to provide tension on coated abrasive belt 12. Pneumatic cylinders 50 are horizontally spaced apart on lower slide 44.

The grinding head assembly thus consists of the upper slide 42, lower slide 44, drive motor 46, contact wheel 14, idler wheel 16, belt 12, and the various other components supported therefrom. Hydraulic cylinder 52 is secured to support plate 48 between the operating rods of pneumatic cylinders 50. The operating rod for hydraulic cylinder 52 is connected to a bracket secured to lower slide 44. Hydraulic cylinder 52 is used to move the grinding head assembly towards and away from table 22 which contains the work piece. The pressure applied to hydraulic cylinder 52 for moving slide 44 downward is regulated so that motor 46 is not overloaded when belt 12 contacts the work piece. Idler pulley 16, which has a 10 inch outer diameter, is supported by upper slide 42 and is offset to achieve 100° of belt contact on the contact wheel 14 after the midpoint in the direction of rotation. Constructing the idler pulley 16 with a diameter smaller than the contact wheel 14 causes more than 180° of contact between the belt 12 and the contact wheel 14. Offsetting the ider pulley 16 from vertical alignment with the contact wheel 14 increases the arc of contact between the belt 12 and contact wheel 14 after the point of engagement with the work piece. This provides increased surface for pulling the belt through the area of contact with the work piece. The idler pulley 16, contact wheel 14 and belt 12 are enclosed in an internally locked housing fabricated from $\frac{1}{8}''$ sheet metal.

Machine base 21 is 26 inches wide, 51 inches deep and $25\frac{1}{4}$ inches high. Base 21 encloses the column oscillating mechanism. Column oscillation hydraulic cylinder 54 is secured between column 40 and base 21. The housing of hydraulic cylinder 54 is connected to base 21 and the operating rod for hydraulic cylinder 54 is connected to column 40. Hydraulic cylinder 54 has a 12 inch stroke. Column 40 is supported from base 21 on roundway roller bearings as manufactured by Thomson Industries, Inc., Manhasset, New York 11030. Column 40 thus follows the movement of the operating rod from hydraulic cylinders 54. The length of stroke and speed of operation of hydraulic cylinder 54 are variable.

Figure 10:
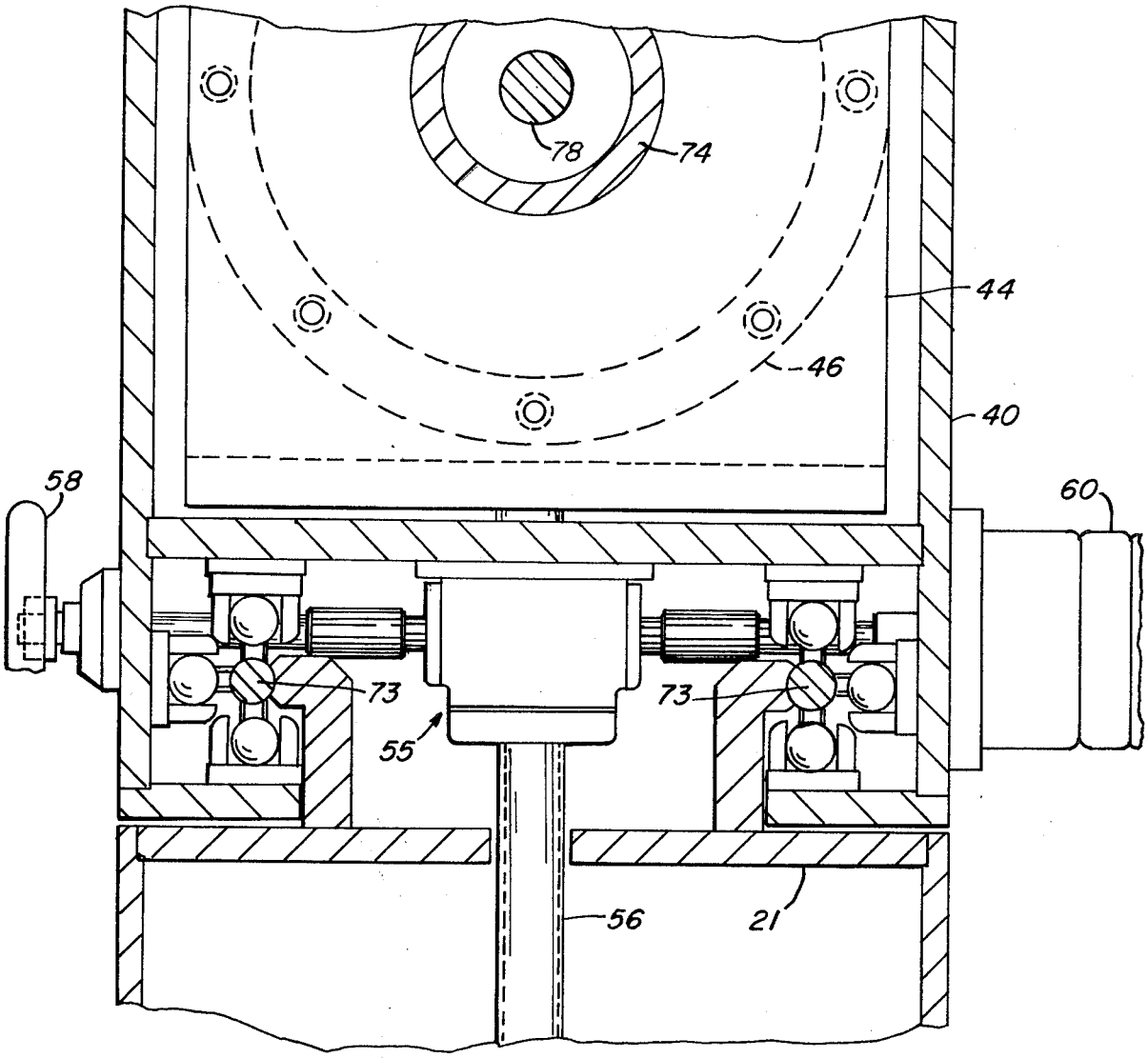
FIG. 10 is a sectional view of the portion of the base and vertical column assembly, illustrating the adjustable fixed stop including the manual and electrical adjustments along the line X—X of FIG. 11.

An adjustable fixed stop 55 is provided on base 21 for limiting downward movement of the grinding head assembly. The adjustable fixed stop 55 is formed from a 10-ton screw jack. The adjustable stop utilizes a threaded rod 56 which can be positioned at a desired height to limit downward travel of lower slide 44. Lower slide 44 includes a rearward extending flange portion 45 which is positioned to engage the top of threaded rod 56 at some downward position as seen in FIG. 10, the height at which threaded rod 56 is set determines how far the contact wheel 14 can move towards work table 22. The height of threaded rod 56 can be set with a manual hand crank 58 or with an electric positioning drive 60. Setting stop 56 thus determines how much material is removed from the work piece. The setting of fixed stop 56 is not affected by positioning of the grinding head assembly. Thus the grinding head assembly can be set to move down in increments until it contacts fixed stop 56 at which point its downward movement will be stopped.

A sheet of flexible material 61 is connected between base 20 and column 40 to prevent material removed during grinding from getting into the oscillating assembly. Bed 20 supports reciprocating work table 22 with a guard 23 provided on one end to catch or deflect grinding swarf. Work table 22 is machined from cast iron and has a 16 inch by 48 inch work area with Tee slots formed therein. The table 22 surface is 36 inches above the floor. Bed 20 is 135 inches long and houses the hydraulic table reciprocating cylinder 62. Hydraulic cylinder 62 is disposed between a fixed portion of bed 20 and table 22 and as the operating rod of cylinder 62 moves between its extended and retracted position table 22 is also moved. Table 22 is supported on Thompson rollway bearings from bed 20. Table 22 thus follows the movement of the operating rod of the table reciprocating cylinder 62. The distance of movement and the speed of operation of hydraulic cylinder 62 can be varied. Sludge collection troughs are provided in bed 20 to provide for drainage of lubricant or coolant for wet grinding or collecting applications.

Figure 4:
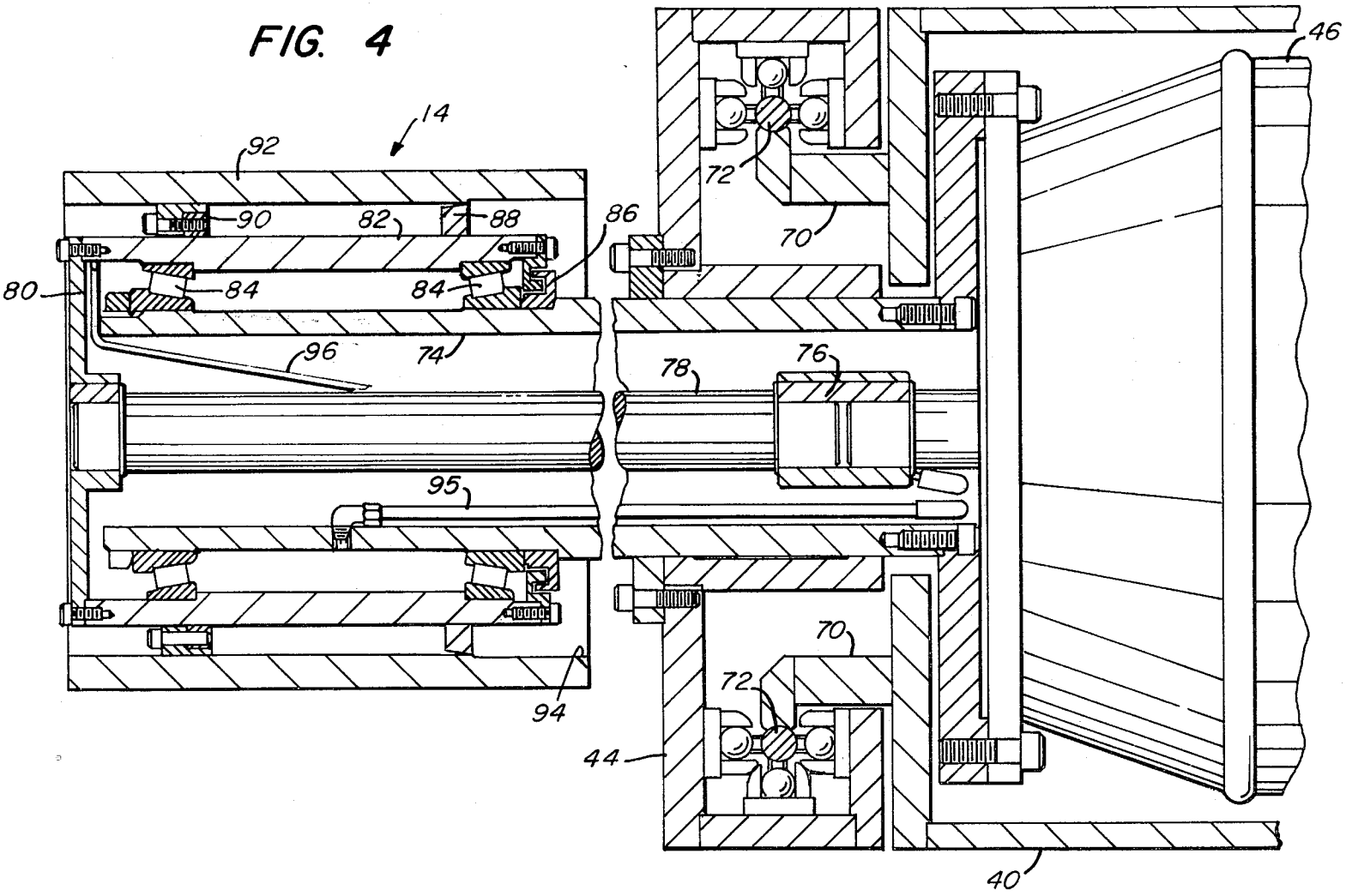
FIG. 4 is a view of the grinding machine shown in FIG. 2 along the lines IV—IV showing the contact wheel slide assembly including the direct drive electric motor.

Referring now to FIG. 4 there is shown a detailed view partially in section of contact wheel 14 and lower slide 44. Projections 70 extend out from column 40 and have hardened and ground shafts 72 attached to the ends thereof. Elongated shaft 72 extends in a vertical direction and provides the guide and support for upper slide 42 and lower slide 44. Slides 42, 44 are supported on Thompson Single Roundway Bearing and Mounting Blocks No. RW-16S from shafts 72. Electric motor 46, which is a type D, is flange mounted to a rear portion of slide 44. A hollow drive pulley spindle 74, which is a tubular shaped member, is securely fastened to lower slide 44. Hollow spindle 74 is longitudinally aligned and concentric with the shaft of motor 46. Motor 46 is coupled by shaft sleeve 76 to drive shaft 78. Drive shaft 78 extends through hollow tubular spindle 74. A circular shaft plate 80 is connected to the outer end of drive shaft 78, which extends from hollow spindle 74. An inner drive pulley 82 extends from the periphery of circular shaft plate 80 towards drive motor 46. Inner drive pulley or hub 82 partially surrounds hollow spindle 74. Inner drive hub 82 is supported by a pair of tapered roller bearings 84 from the outer diameter of tubular spindle 74. A seal 86 is provided on the free end of inner hub 82 to provide a seal between inner hub 82 and the outer diameter of hollow spindle 74. Hollow spindle 74 is constructed to take the load applied when grinding an article without undue deflection.

Annular projections 88 and 90 are provided around inner hub 82. Drive pulley 92 which preferably has a 16 to 20 inch outer diameter fits over and is connected to inner drive hub 82. Fasteners are provided for connecting outer drive pulley 92 to annular rings 90 so that inner drive hub 82 and outer pulley 92 rotate as a unit. Annular ring 88 is formed with a slight taper and the inner end of drive pulley 92 has an undercut 94 so that when the fasteners are removed, drive pulley 92 can easily be removed from inner hub 82 without disturbing the bearings 84. The relatively rigid tubular spindle 74 which extends within drive pulley 92 provides support and prevents damage to the motor bearings. The direct drive shaft from motor 46 provides no support for contact pulley 92. This disclosed construction allows the elimination of an outboard support for the contact wheel assembly 14. The load on the drive pulley 92 is divided equally between the two tapered roller bearings 84. For a grinding machine it is necessary that the machine be able to withstand the applied pressure and still maintain accuracy. Having the bearings 84 sealed within the inner hub 82 prevents them being damaged by operating personnel when the contact wheel 92 is removed or changed. Preferably contact wheel 92 has a 16 inch 20 18 inch outer diameter with a steel or rubber banded outer surface. Various other types of contact wheels 92 can be provided when desired.

Hydraulic fluids for cooling and lubricating bearings 84 are provided through tube 95 which extends within hollow spindle 74. If the bearings 84 were not cooled, they would go through a large temperature change and since the bearings are relatively large they would go through a large tolerance change and this would affect the machine accuracy. If the bearings temperature change was too great the bearings could become loose and give significantly less accurate operation. The hydraulic cooling and lubricating is provided from the same hydraulic supply which operates the various hydraulic cylinders on the machine. The hydraulic cooling is helpful in maintaining a given temperature change throughout the sealed portion of the pulley assembly 14 without changing the tolerance. The hydraulic cooling of bearings 84 also provides for long life.

Outboard support bearings for the contact wheel are commonly used on prior art belt grinders. Eliminating the outboard support bearing for the contact wheel 14 simplifies belt replacement and changing of the contact wheel. A return tube 96 is provided for returning oil to the hydraulic supply. A constant flow of oil is provided by force feeding oil through line 95 to the location of bearings 84. The pumped oil finds its way to the area where it can be picked up and returned through tube 96.

As oil enters the sealed rotating drive hub 82 it is forced against the inner diameter by centrifugal force. This area partially fills with oil during operation. Tube 96, which is stationary, has an opening facing against the direction the oil will rotate within drive hub 82. The position of the inlet opening in tube 96 will determine the depth of oil in the rotating drive hub 82. The oil within hub 82 balances the contact wheel assembly 14 and this provides for smooth operation. If desired tube 96 can be oriented with its intake opening at the bottom of drive hub 82. A vacuum pump can also be provided for drawing the oil out of drive hub 82.

Figure 5:
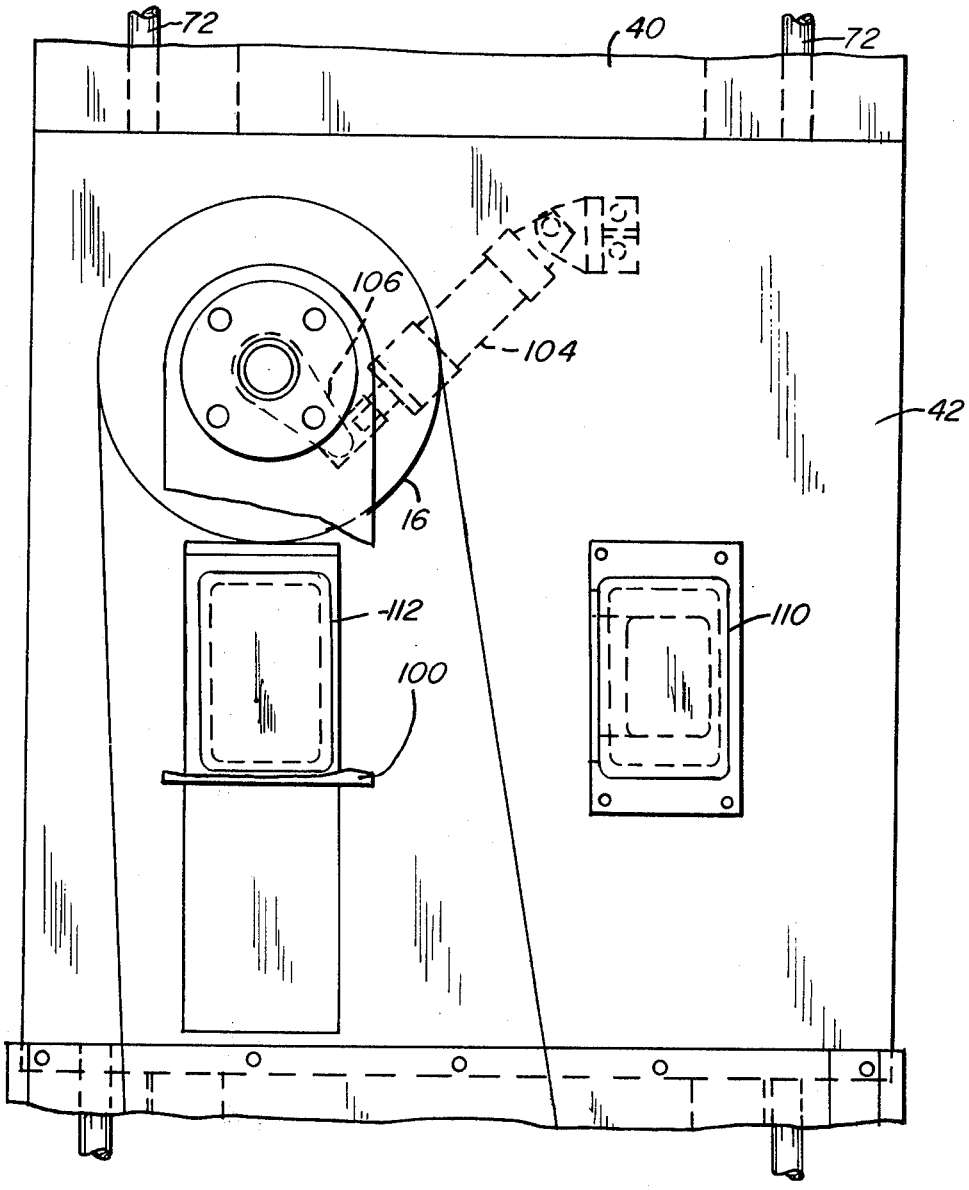
FIG. 5 is a front view of a portion of the grinding machine shown in FIG. 1 showing the idler wheel slide assembly.
Figure 6:
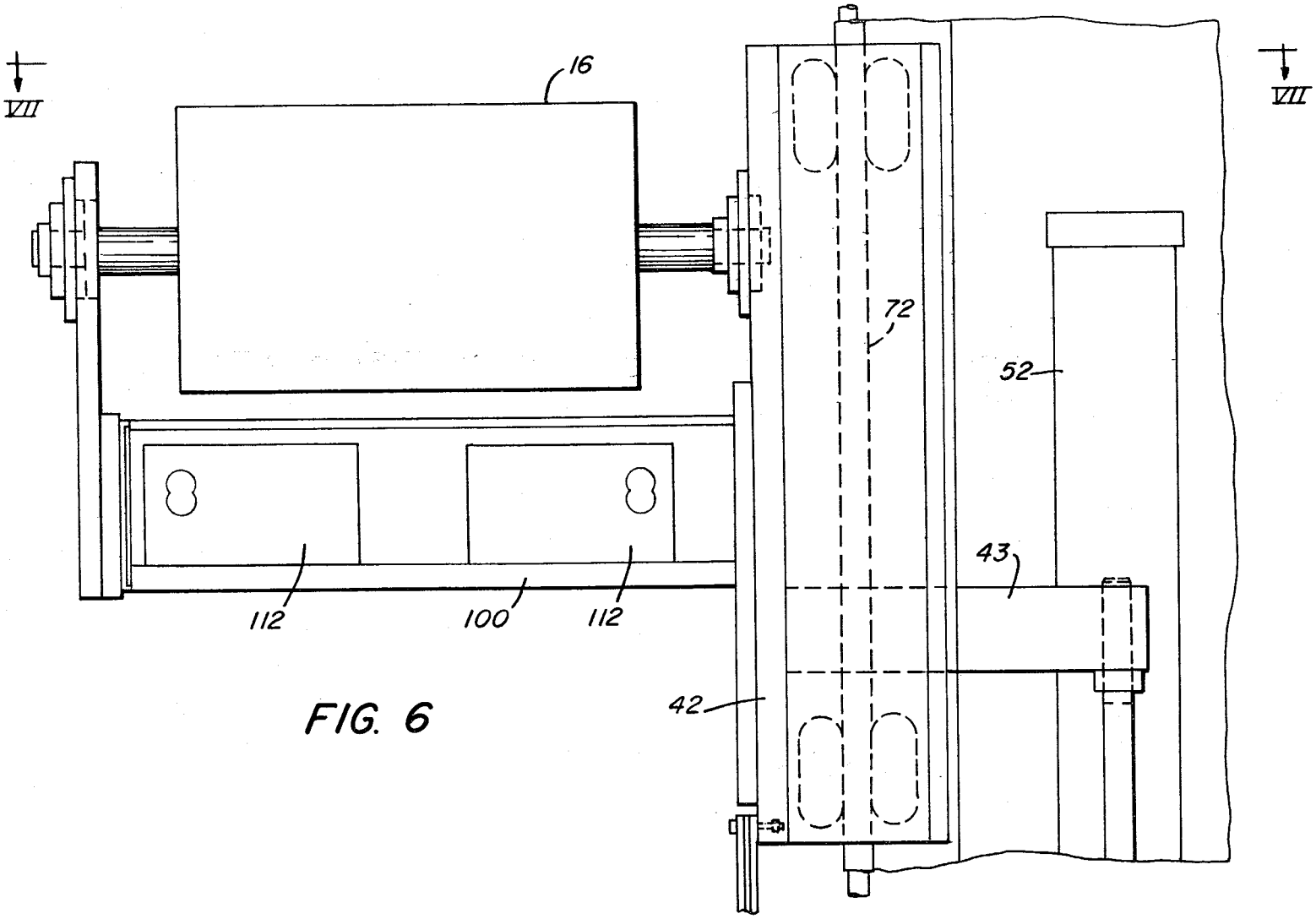
FIG. 6 is a side view of the portion of the grinding machine shown in FIG. 5.
Figure 7:
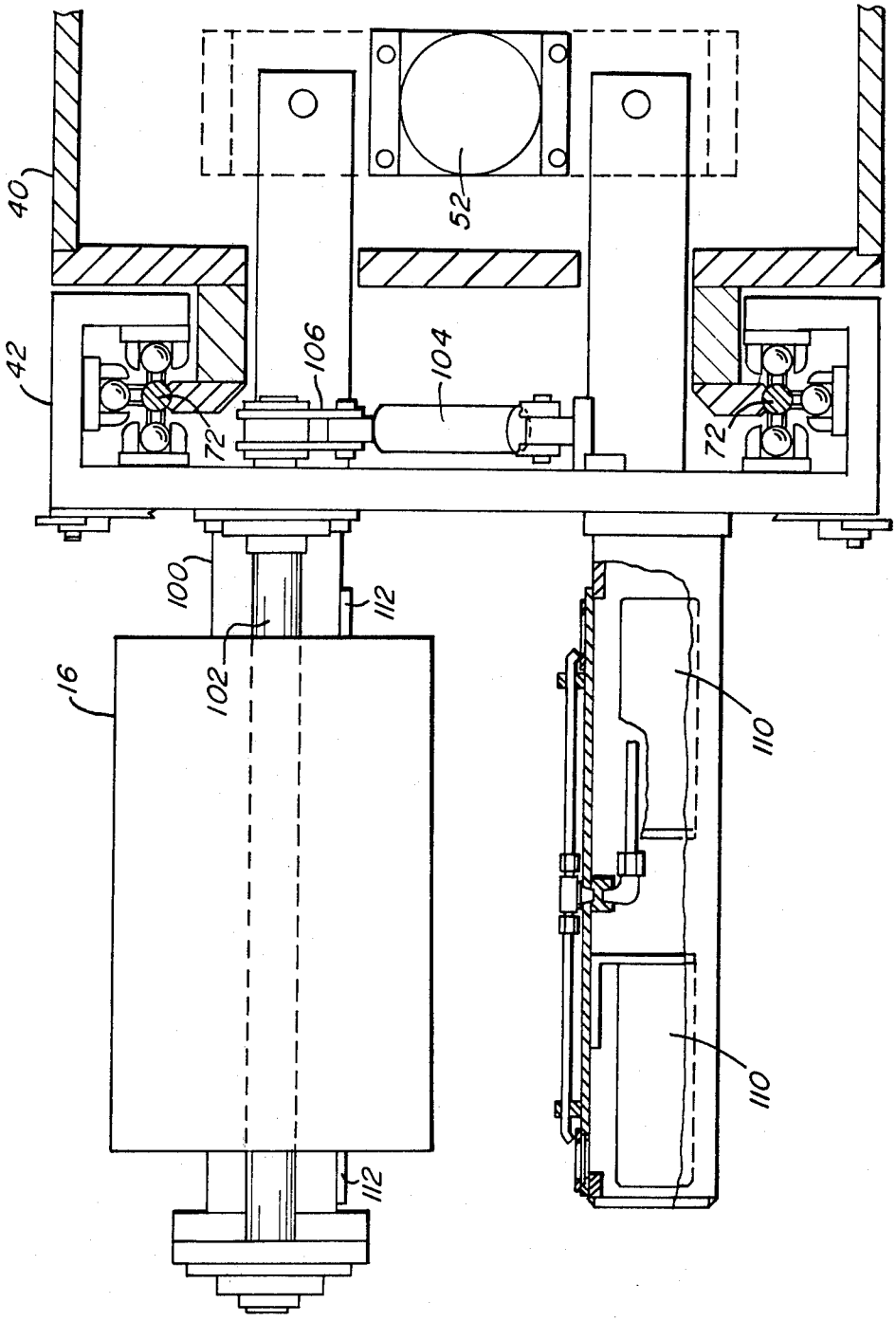
FIG. 7 is a top view in FIG. 6 along the line VII—VII.

Referring now to FIGS. 5, 6 and 7, there is shown a more detailed view of a portion of the vertical column 40, illustrating the idler pulley 16 and the electro optical tracking devices. The upper slide 42 is supported from ground and hardened vertically extending rods 72 which are connected to the structure of vertical column 40. Idler pulley 16 is 10 inches in diameter and is offset to achieve 100° C. of belt contact on the pulling side of contact wheel 14. A fabricated bracket 100 provides an outboard idler pulley support. Idler pulley 16 is supported from a solid eccentric idler spindle 102.

Figure 8:
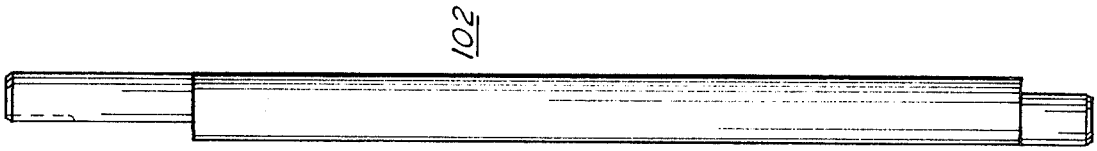
FIG. 8 is a view of the idler pulley shaft showing its eccentric construction.

Idler spindle 102 which can best be seen in FIG. 8 is machined with the center offset at each end. That is, the longitudinal axis of the portion of spindle 102 which supports pulley 16 is not aligned with the longitudinal axis defined by the ends of spindle 102. The ends of shaft 102 lie along a common axis and are supported by bearings for rotational movement only. As shaft 102 rotates the axis of idler pulley 16 moves with respect to contact pulley 92. Hydraulic cylinder 104 is connected by a bracket 106 to one end of idler spindle 102. The eccentric shaped spindle 102 permits precise steering of belt 12 to obtain the desired tracking by slight adjustments utilizing small hydraulic cylinder 104. By rotating slightly the end of eccentric spindle 102 a slight shift in the vertical and horizontal planes can be provided on idler pulley 16 relative to contact pulley 92 for accurate belt tracking. Cylinder 104 is activated by a photoelectric sensing system; preferably that system includes modulated, infrared, LED emitting and sensing devices (e.g. Honeywell Model FEMLS5A) which sense edgewise movement of belt 12. Photosensors 112 are attached to brackets 100 which provide outboard support for spindle 102. Photo emitters 110 are spaced apart from the photosensors 112 with the edges of the coated abrasive belt 12 passing therebetween. Photosensors 112 sense when belt 12 has moved from the desired position and actuate hydraulic cylinder 104 to shift spindle 102 in the proper direction to return belt 12 to the desired position. After spindle 102 has been shifted a slight amount a short time delay is provided which permits belt 12 to move to the desired position. After the short time delay the position of belt 12 is again sensed and if the desired position has not been reached hydraulic cylinder 104 is again activated to position belt 12. With the disclosed arrangement belt 12 can be maintained quite simply within a close tolerance to the desired position. Eccentric shaft 102 is merely adjusted by hydraulic cylinder 104 to steer the belt 12 to the desired position. The amount of eccentricity on spindle 102 is not critical and for a selected hydraulic cylinder 104 the required eccentricity would be obvious to one skilled in the art. Photoelectric emitters and sensors 110 and 112, respectively, continue moving belt 12 until it remains at the desired position. In the disclosed device the belt will move in a slow manner. Appropriate shielding means may be desirable to confined the infrared light source. It also may be desirable to provide for fluid flow over the lenses of the photoelectric devices to keep the lenses clean.

When putting on a new belt if for example it was sitting on its side in a damp area, it may tend to want to move quickly off the machine before the eccentric spindle can be properly adjusted. In this case the operator will jog the machine a little bit to allow the eccentric spindle to be automatically positioned to center the belt.

Figure 9:
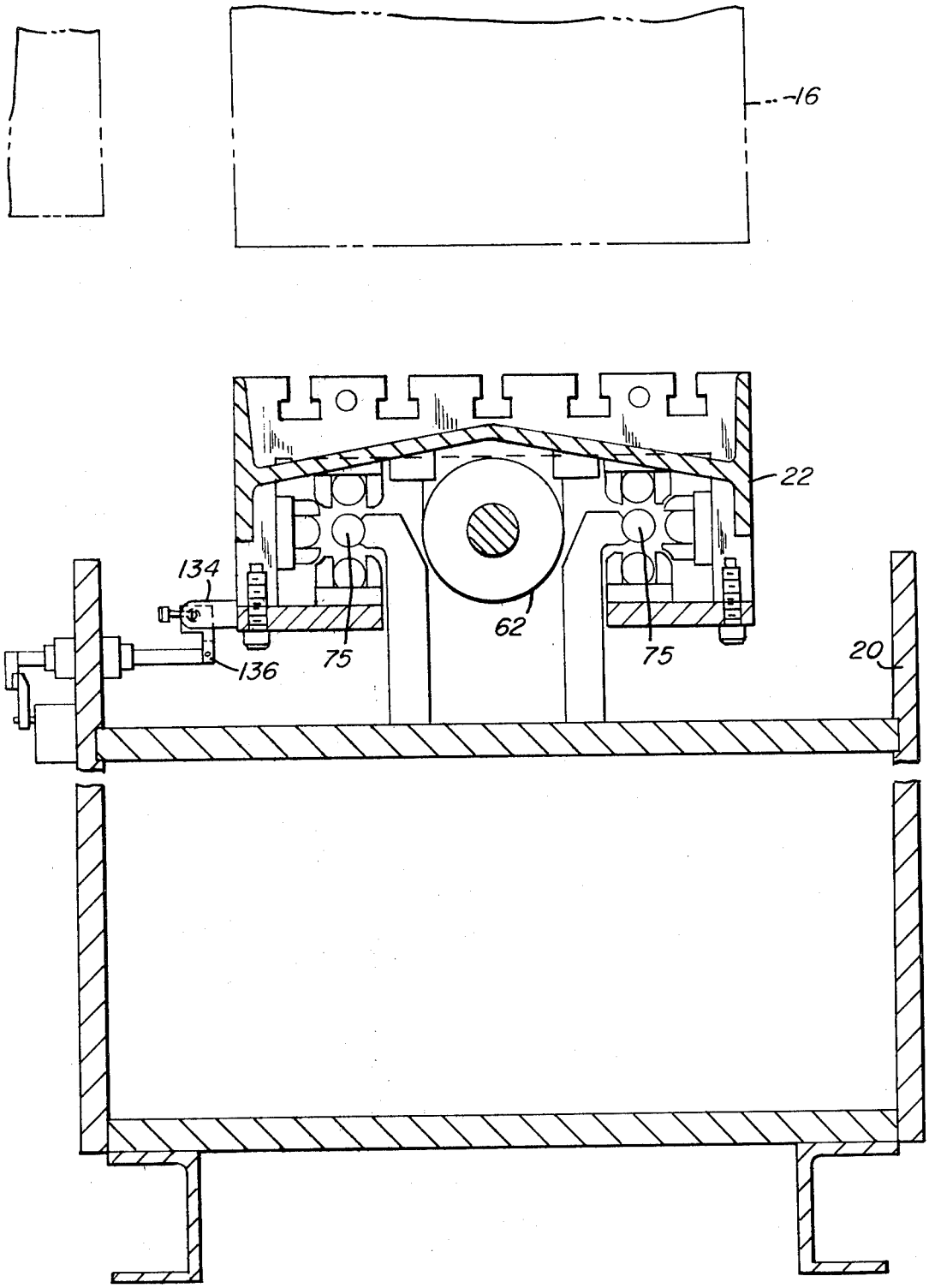
FIG. 9 is a view in FIG. 3 along the line IX—IX.

Referring now to FIG. 9 there is shown a section view through bed 20. Table 22 is supported to move on horizontally extending ground and hardened rod 75 which are supported from fixed bed 20. As contact wheel 14 is lowered by the incremental feed, it contacts the work piece which is supported on the reciprocating table 22. Hydraulic cylinder 62 reciprocates table 22. A half round slide rod 134 is provided on the side of table 22 on which are mounted actuating arms 130, 132 which are used to control the length of stroke of hydraulic cylinder 62.

Figure 11:
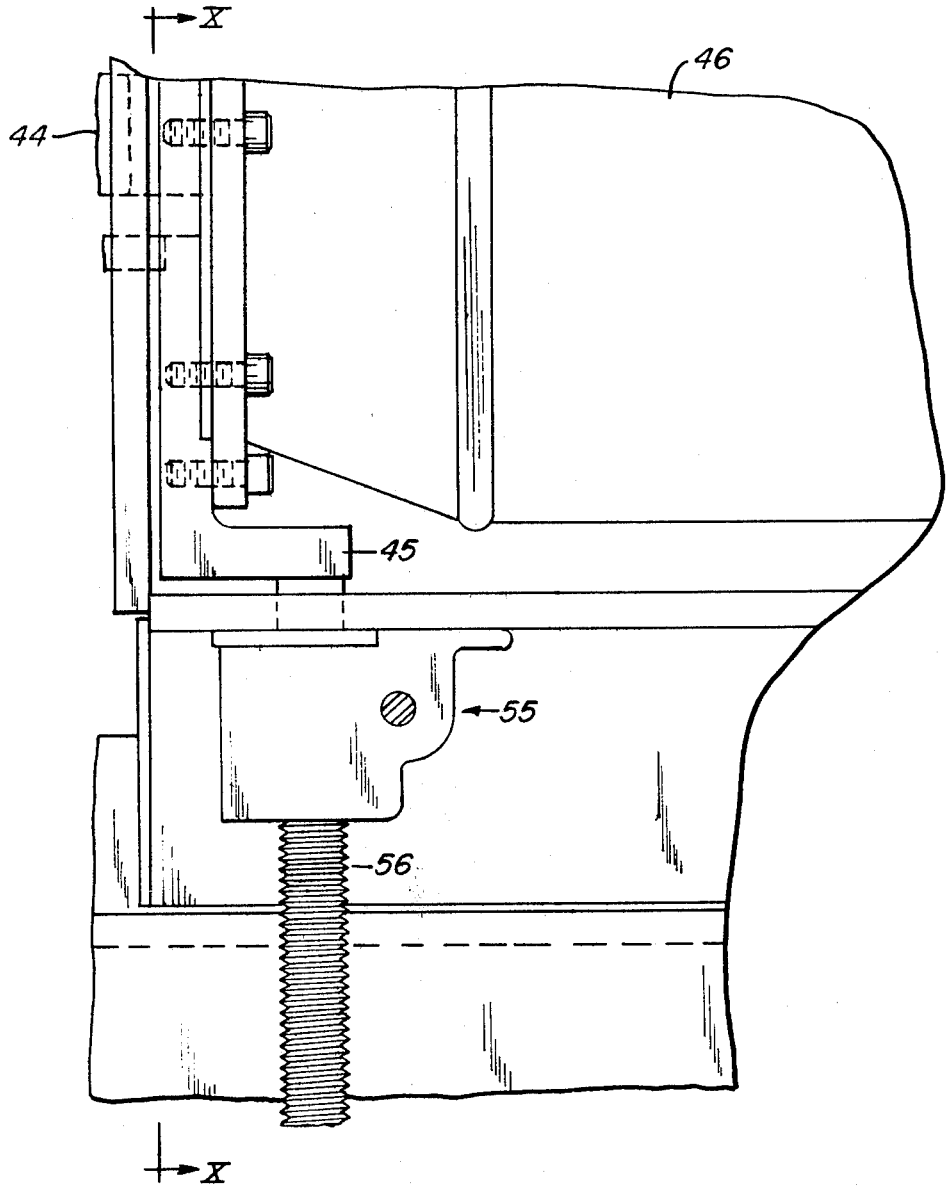
FIG. 11 is a view of a portion of the grinding machine showing the adjustable fixed stop engaging the contact wheel slide assembly.

Referring now to FIGS. 10 and 11 there is shown a more detailed illustration of the adjustable fixed stop screw 55 utilized on the disclosed belt grinding machine. The position of stop 55 can be set by the manual hand wheel 58 or the electric drive 60. The electric drive 60 has an electric starter provided in the electric panel and is used for rapid setting of stop 55. Stop 55 is provided with an 18 inch travel. By raising stop 55 above the work piece and using hydraulic cylinder 52 to bias lower slide 44 into contact with stop 55 manual controlled down feeding of the grinding head is possible. As the stop is lowered below the work piece, the grinding head will follow.

Oscillating column 40 rides on fixed rods 73. Horizontal fixed rods 73 are supported from fixed base 21. Roundway roller bearings support vertical column 40 from fixed rods 73. The electric drive 60, the manual drive operator 58 and the stop 55 move with column 40. A slotted opening is formed for receiving threaded rod 56 where it extends into base 21. The disclosed fixed stop arrangement positively limits downward movement of the grinding head. Thus if the grinding head is raised for any reason, such as to change belts 12, it will automatically return to the fixed stop position without requiring a new set up.

Figure 14:
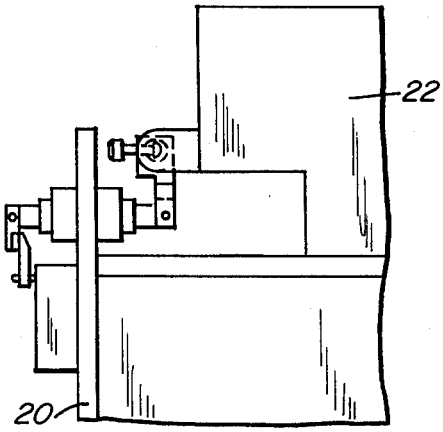
FIG. 14 is an end view of the portion of the grinding machine showing the limit switch arrangement for controlling table reciprocation.
Figure 15:
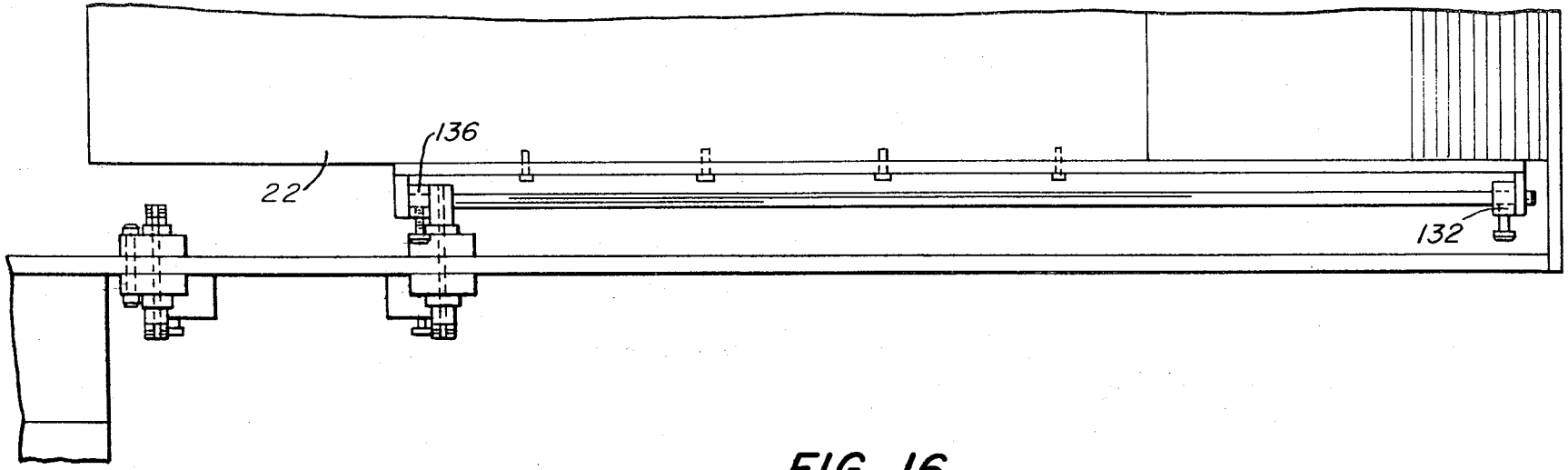
FIG. 15 is a top view of FIG. 14.
Figure 16:
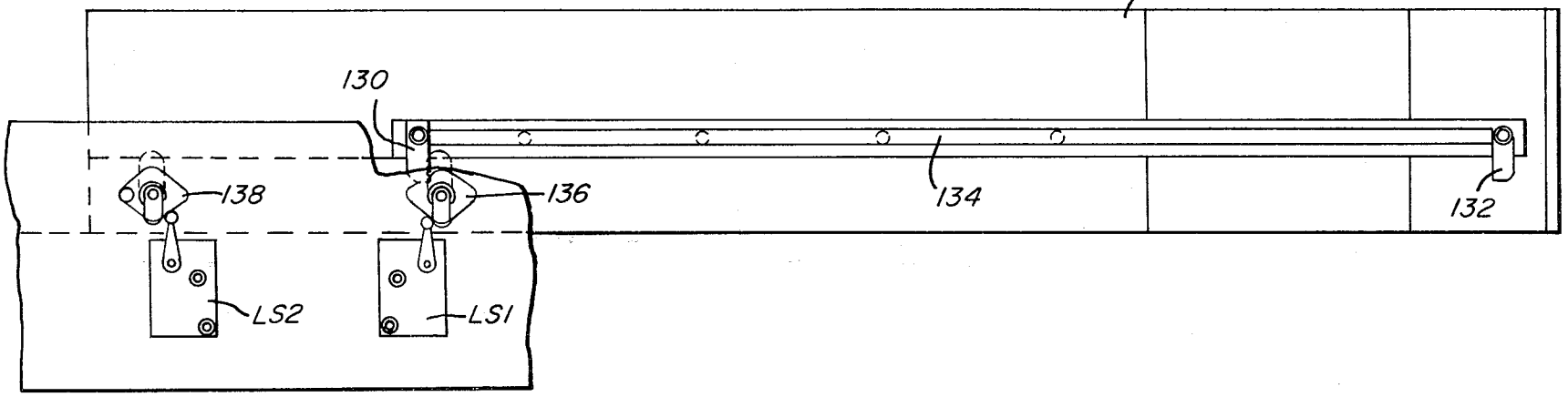
FIG. 16 is a side view of FIG. 14.

Referring now to FIGS. 14, 15 and 16 there is shown a limit switch arrangement for controlling the movement of table 22. A left hand arm 130 and a right hand arm 132 are attached to a semi-circular slide 134 which is connected for movement with table 22. The position of arms 130 and 132 on rod 134 is adjustable. Operating assemblies 136 and 138 are provided for switching limit switches LS1 and LS2 respectively. Arm 132 turns operating assembly 138 to switch limit switch switch LS1. Arm 130 is offset to bypass operating assembly 138 as table 22 moves and arm 132 is offset to bypass operating assembly 136 as table 22 moves. When arm 132 contacts operating assembly 138 limit switch LS2 is operated and four way valve 126 connected to cylinder 62 is operated to reverse the direction of hydraulic cylinder 62 which controls movement of table 22.

Figure 12:
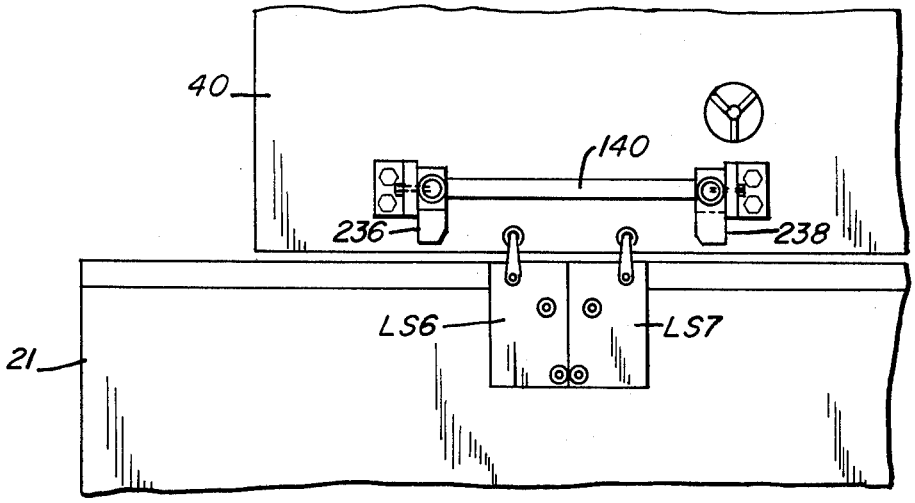
FIG. 12 is a side view of a portion of the grinding machine showing the limit switch arrangement for controlling column oscillation.
Figure 13:
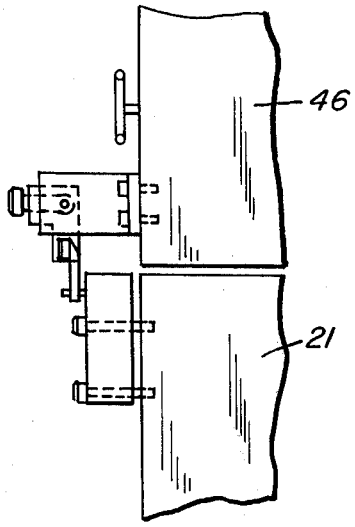
FIG. 13 is an end view of FIG. 12.

The oscillation of column 40 is controlled by a similar limit switch and arm arrangement as shown in FIGS. 12 and 13. As shown in FIGS. 12 and 13 arms 236 and 238 are provided on a slide 140 which is attached to oscillating column 40. Arm 236 activates limit switch LS7 and arm 238 activates limit switch LS6 to control the distance of oscillation of column 40. Arms 236 and 238 can be positioned as desired along slide 140.

Figure 17:
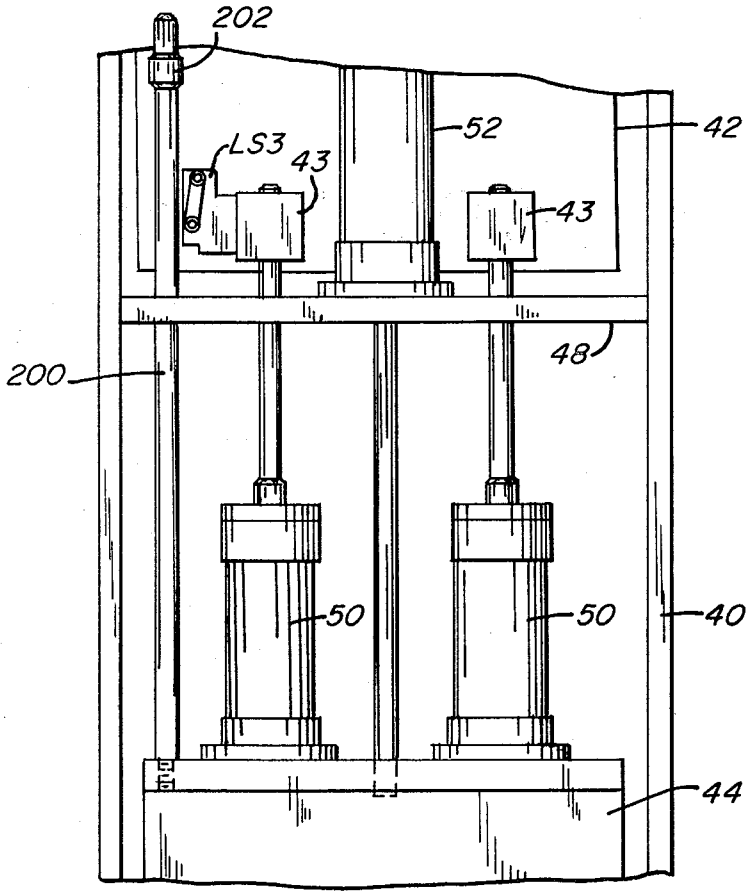
FIG. 17 is a rear view of the vertical column with some portions removed for clarity showing the limit switch which senses belt tear.

FIG. 17 shows the position of a limit switch LS3 which when activated cause lower slide 44 to raise up. As pointed out previously air cylinders 50 bias slides 42 and 44 apart. Hydraulic cylinder 52 moves lower slide 44. An operating rod 200 is connected to lower slide 44 with an actuator 202 positioned thereon. Actuator 202 is disposed to active a limit switch LS3 if slides 42 and 44 separate by more than a predetermined distance. Actuator 202 is positionable on rod 200 and is set to activate limit switch LS3 at a separation which could only be achieved when belt 12 breaks. Limit switch LS3 when activated controls the four way valve 126 connected to cylinder 52 to raise lower slide 44. Limit switch LS3 is electrically connected to override the various other limit switches so as to immediately raise the grinding head when activated. Lower slide 44 which supports contact wheel 14 is thus automatically raised when belt 12 breaks.

Figure 18:
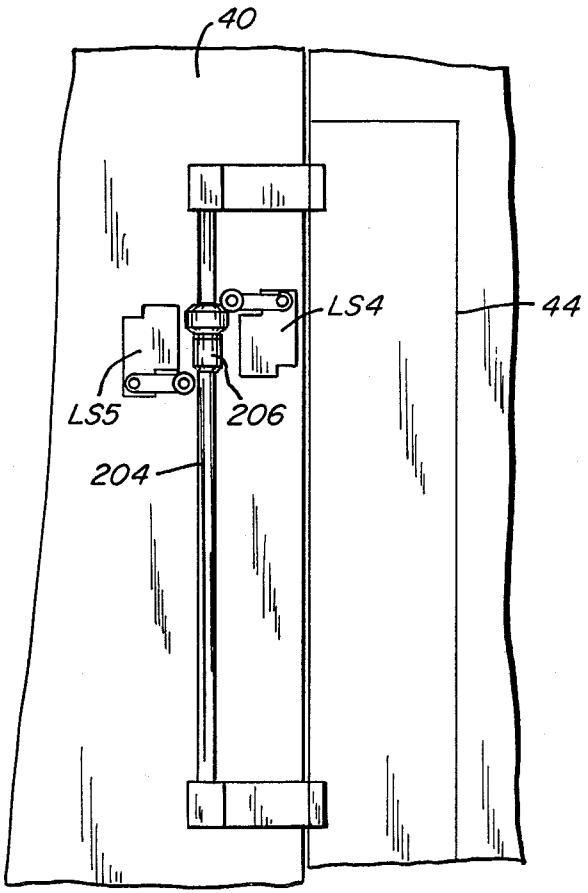
FIG. 18 is a view of a portion of the vertical column and lower slide showing the final pass limit switch and the head positioning limit switch; and, FIG. 19 is a schematic of the hydraulic system utilized on the disclosed belt grinding machine.

FIG. 18 shows the arrangement to two limit switches LS4 and LS5 which are utilized on grinder 10. Limit switches LS4 and LS5 are positionable on column 40. A rod 204 having an actuator 206 is connected for movement with lower slide 44 and is disposed between limit switches LS4 and LS5. Limit switch LS5 is set to be activated when lower slide 44 contacts stop 55. When limit switch LS5 is activated, through appropriate electrical interfacing, it causes table 22 to reciprocate for a final pass and then raises the grinding head. The grinding head raises until actuator 206 activates limit switch LS4. Limit switch LS4, through appropriate interfacings, then limits upward movement of lower slide 44. Limit switch LS4 is set at a height slightly above the height of the rough work piece. Thus, the required movement of the operating rod for cylinder 52 is kept to a minimum.

Figure 19:
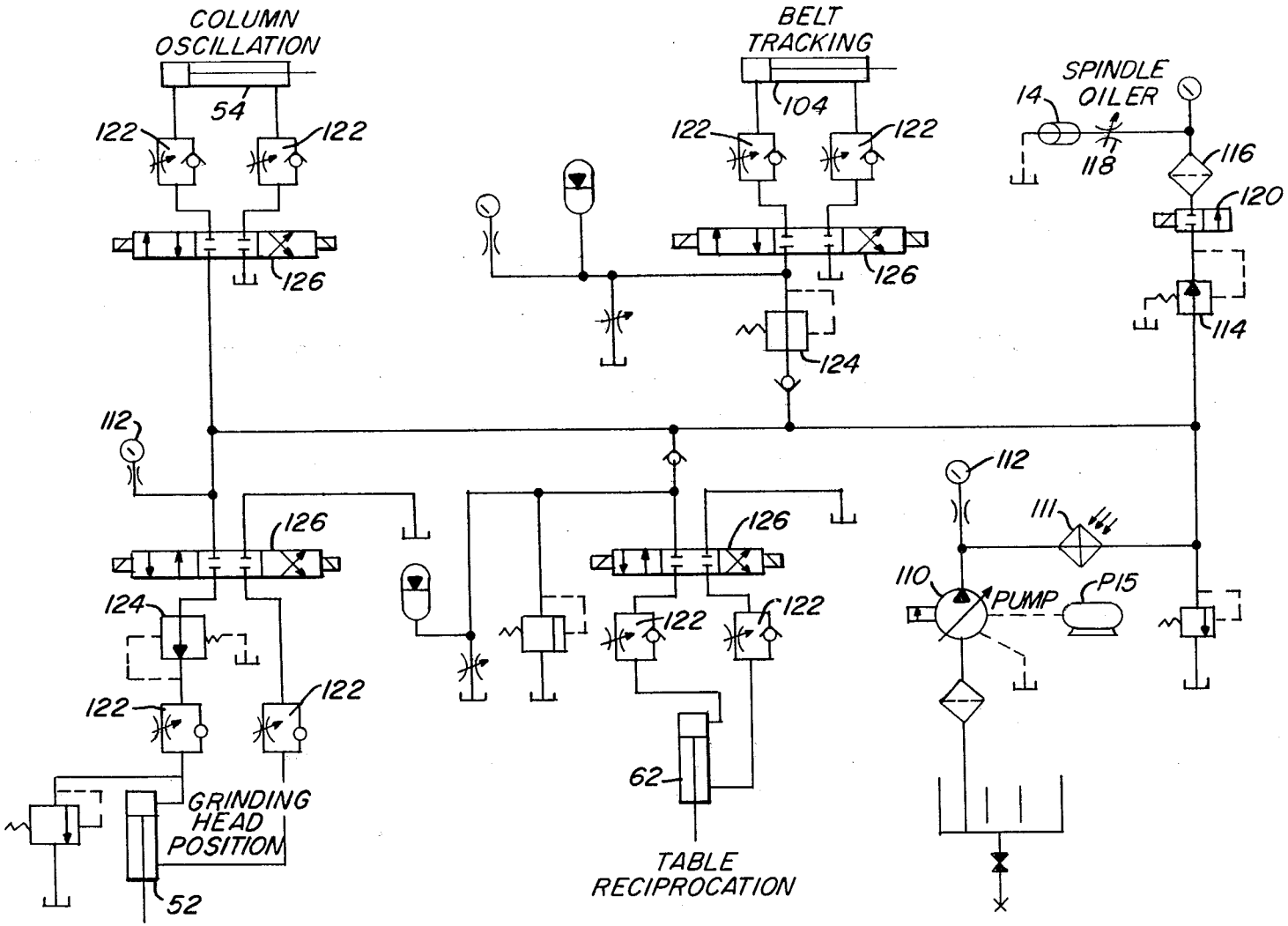

Referring now to FIG. 19 there is shown a hydraulic schematic for the hydraulic system utilized on belt grinder 10. Pump 110 is driven by a 15 horse power motor P15 and supplies hydraulic fluid, at a pressure of approximately 1000 psi, for operating the various hydraulic cylinders and cooling contact wheel bearings 84. A heat exchanger 111 can be provided for cooling the hydraulic fluid if desired. Pressure gauges 112 are provided for indicating the supply line pressure. A pressure reducer 114 and a filter 116 are provided in the hydraulic supply lines to the contact wheel assembly 14. A flow control valve 118 is provided for regulating the amount of oil fed to the contact wheel spindle 74 for cooling bearings 84. An electrically operated two way valve 120 is provided for turning on and off the hydraulic fluid flow to the contact wheel spindle 74.

Adjustable flow control valves with a bypass 122 are provided in the hydraulic lines which feed pressurized fluid to either side of the double acting hydraulic cylinders 52, 54, 62 or 104, to control the speed of operation in either direction. The flow control valves 122 provided in the lines to the grinding head positioning cylinder 52 are set to raise the grinding head fast and to bring it down slowly. A pressure reducing valve 124 is also provided in the hydraulic line feeding the down port of hydraulic cylinder 52. Pressure reducing valve 124 controls the downstroke pressure of cylinder 52 so that the grinding head will ride up if motor 46 approaches a stall condition. That is, the pressure of pressuring reducing valve 124 is set so that the drive motor will not be overloaded if the amount of material attempted to be removed is too great. A four way three position valve 126 is connected in the lines feeding cylinder 52 to either raise or lower the grinding head assembly. Grinding head valve 126 connects either the up or down port of hydraulic cylinder 52 to the hydraulic supply and connects the other port to the hydraulic reservoir.

The four way three position valve 126 connected in the hydraulic lines to cylinder 62 controls the direction of table 22. The four way three position valve 126 connected in the hydraulic lines to cylinder 54 controls the direction of the oscillating vertical column 40. The four way valve 126 connected to the tracking cylinder 104 controls the direction of tracking cylinder 104. A pressure regulator 124 is provided in the hydraulic supply line to tracking cylinder 104 to reduce pressure and improve control.

All of the control valves 126 are electrically operated. The energizing of the various solenoids which operate valves 126 is controlled by various limit switches which are positioned to obtain the desired operation.

The electrical controls are enclosed in a freestanding NEMA panel box (not shown) approximately 36 inches wide×60 inches high. A control panel (not shown) which includes a 25 hole push button station and machine disconnect is mounted on a pedestal from base 21. The freestanding panel also houses across line starters for the main drive motor 46, the hydraulic pump motor P15, and the rapid traverse motor 60. A push button is provided for turning on control power and this is indicated by a white pilot light. A digital read out is provided for indicating the position of the grinding head. Push buttons are provided for energizing the starters for the various electric motors. An ammeter is provided on one of the lines feeding drive motor 46 to indicate the current being drawn. A push button is provided for initiating reciprocation of table 22. Table 22 continues reciprocating until lower slide 44 contacts stop 55 at which point a limit switch is closed and table 22 is reciprocated for one final pass. After the final pass the grinding head is raised to a selected position. The finished work piece can then be removed and a new one inserted and the cycle repeated.

The grinding head assembly is enclosed in a steel covered bottomless enclosure having a door which can be remotely locked. The disclosed coated abrasive belt grinding machine has numerous advantages over prior art machines such as column oscillation for uniform belt wear, variable speed reciprocating table, elimination of outboard supports for the contact wheel, fast belt and contact wheel change, automatic grinding head lifting in the event of belt breakage, simplified and accurate tracking, and an operating control panel which is located to the side of the column away from grinding swarf. The modular construction lends itself to extending and widening the table and bed, utilizing multiple heads for roughing and finishing in single pass operations, and conveyor or roller feed to minimize material handling. The incremental feed mechanism is an integral part of the machine and is used to set and control the downfeed of the grinding belt head between passes of the reciprocating table.

Each time table 22 reciprocates limit switch LS2 is switched. Limit switch LS2 then activates an adjustable timer which energizes three way valve 126 feeding cylinder 52 to move cylinder 52 towards the extended position for a set period of time. This is repeated each time table 22 reciprocates. The grinding head is thus fed down in adjustable steps.

The disclosed coated abrasive grinding machine provides a high speed, high pressure stock removal system which utilizes the endless coated abrasive belt 12 to grind planar surface of various materials. Typical belt speeds of 8000 surface feet per minute coupled with the feed rates of 25 to 40 feet per minute generate temperatures in the contact area which approach the melting point of the material being abraded. This condition aides the machining process by reducing friction and correspondingly increases belt life. Heat built up in the work piece is minimal because over 90% of the energy generated is removed by the swarf. Metal removal rates of the disclosed machine will approach 60 cubic inches of cast iron per minute per square inch of contact surface area between the contact wheel and the work piece. The horsepower requirements in a sustained metal removal operation are about 2 horsepower per cubic inch per minute. Motor 46 can be thus sized for the desired removal rate. The disclosed machine offers users production rates which are substantially faster than milling or planing. Additionally, the relatively low cost of coated abrasive belts as compared with carbide bits or grinding wheels gives the disclosed machine a tool cost advantage. Down time for belt changing is very small.

The disclosed belt grinder 10 can be used in a great variety of industries. Foundries can use the belt grinding machine for gate and riser removal and surface qualification. Casting and forging plans can use belt grinding machining 10 for surface machining such items as pumps, valves, engine blocks, transmission housings, manifolds, clutch plates and the like. Tool and die makers can use grinding machine 10 for dimensioning of bar stock, molded base machining, and die surfacing and resurfacing. Fabricators can use grinding machine 10 for weld bead removal and surface machining. Prime metal industries such as steel can use the disclosed grinding machine for billet conditioning, billet test piece machining and finishing. Refractories can use the grinding machine for refractory block dimensioning, slide gate machining, and die resufacing. The vitreous china industry can use the disclosed grinding machine for surface grinding on such items as toilet bowl foot or stall urinals. The glass industry can use the disclosed grinding machine for edge and surface grinding on items such as windshields, and plate mirror blanks. Cement block makers can use grinding machine 10 for block dimensioning and facing. The carbon industry can use the disclosed grinding machine for graphite block dimensioning and anode grinding. Industries which use flame cutters and parts users can use grinding machine 10 for clean up of slag.

What is claimed is:

1. A belt grinder for grinding an article comprising:

a vertical column which is continuously movable back and forth along fixed guides while grinding the article;

a grinding head which is movable as a unit and which comprises:

an upper slide supported from said vertical column for independent sliding movement;

a lower slide spaced apart from said upper slide and supported from said vertical column for independent sliding movement;

an idler pulley supported from said upper slide;

a driven pulley supported from said lower slide;

a coated abrasive belt disposed around said idler pulley and said driven pulley;

biasing means comprising a pneumatic cylinder disposed between said upper slide and said lower slide for providing opposed biasing forces on said upper slide and said lower slide apart to provide tension on said coated abrasive belt; and a drive motor for driving said driven pulley;

a movable table disposed beneath said grinding head for receiving the article to be ground;

a hydraulic supply for supplying pressurized hydraulic fluid; and, double acting hydraulic actuating means connected to said grinding head for moving said grinding head toward and away from said table having a first port, which receives hydraulic fluid from said hydraulic supply to move said grinding head towards said movable table, and into engagement with the article, and a second port, which receives hydraulic fluid from said hydraulic supply to move said grinding head away from said movable table.

2. A belt grinder as claimed in claim 1 comprising:

a first adjustable flow control valve connected in series with the hydraulic connection to said first port for controlling the speed at which said grinding head moves toward said table; and a second adjustable flow control valve connected in series with the hydraulic connection to said second port for controlling the speed at which said grinding head moves away from said table.

3. A belt grinder as claimed in claim 1 comprising:

an adjustable stop located beneath said bottom slide for limiting movement of said grinding head towards said table.

4. A belt grinder as claimed in claim 1 wherein:

said pressure regulator means is set for a pressure which is determined by the horsepower of said drive motor to prevent overloading of said drive motor.

5. A belt grinder for grinding a flat surface on an article comprising:

a movable column;

a movable table for receiving the article to be ground;

an idler wheel slidably supported for independent movement on said column;

a contact wheel slidably supported for independent movement on said column spaced apart from said idler wheel and disposed towards said table;

an endless coated abrasive belt disposed around said idler wheel and said contact wheel;

tensioning means disposed between said idler wheel and said contact wheel for providing opposed biasing forces on them and applying tension to said endless coated abrasive belt and providing for unitary movement of said idler wheel and said contact wheel;

feed means connected to bias said idler wheel, said contact wheel, and said endless coated abrasive belt towards said table;

an adjustable stop secured to said column for stopping said contact wheel at a selected position spaced apart from said table;

a table drive for continually moving said table back and forth during grinding; and a column drive for continually moving said column back and forth during grinding.

6. A belt grinder as claimed in claim 5 wherein said feed means comprises:

adjustment means for adjusting the bias of said feed means.

7. A belt grinder as claimed in claim 6 wherein said feed means comprises:

a hydraulic cylinder operable between an extended position and a retracted position connected for moving said contact wheel towards and away from said table; and, adjusting means for adjusting the pressure with which said hydraulic cylinder moves towards an extended position.

8. A belt grinder as claimed in claim 5 comprising:

a table reciprocating means for reciprocating said table back and forth; and, feed control means for feeding said contact wheel towards said table a selected amount each time said table reciprocates.

9. A belt grinder for surface grinding an article comprising:

an elongated bed;

a table, for receiving the article, movable back and forth along the longitudinal axis of said bed;

a movable vertical column supported on fixed guides extending transverse to said table;

table drive means for continuously moving said table back and forth;

column drive means for continuously moving said vertical column back and forth;

a grinding head assembly supported above said table and movable as a unit for sliding movement along said vertical column, and said grinding head assembly comprises a drive motor, a contact wheel supported from said vertical column for independent sliding movement and driven by said drive motor, an idler wheel spaced apart from said contact wheel supported from said vertical column for independent sliding movement and, a pneumatic cylinder disposed between said contact wheel and said idler wheel for providing opposed biasing forces on said contact wheel and said idler wheel, and a coated abrasive belt disposed around said contact wheel and said idler wheel;

automatic feed means for incrementally moving said grinding head assembly towards said table each time said table reciprocates comprising, a hydraulic supply for supplying pressurized hydraulic fluid, hydraulic feed means having a pair of ports which are connectable to said hydraulic supply for moving said grindinghead assembly, limit switch means positioned to be activated each time said table reciprocates for sensing each time said table reciprocates, and, timer means responsive to said limit switch means for supplying hydraulic fluid to said hydraulic cylinder, for a selected period of time, each time said table reciprocates.

10. A belt grinder as claimed in claim 8 comprising:

flow adjusting means connected to the ports of said hydraulic cylinder for controlling the rate at which hydraulic fluid is supplied to said hydraulic cylinder to control the speed of operation of said hydraulic cylinder.

11. A belt grinder as claimed in claim 8 comprising:

an adjustable stop positionable to limit movement of said grinding head assembly towards said table.

12. A belt grinder as claimed in claim 8 comprising:

safety lift off means for raising said grinding head assembly when said coated abrasive belt breaks.

13. A belt grinding machine as claimed in claim 12 wherein said safety lift off means comprises:

a limit switch fixed with respect to said biasing means to be activated when said belt breaks to supply hydraulic fluid to the inlet of the hydraulic cylinder which moves said grinding head assembly away from said table.

14. A grinding machine comprising:

a movable vertical column;

an idler pulley assembly supported by said vertical column for independent sliding movement along said vertical column;

a contact pulley assembly connected to said vertical column for independent sliding movement along said vertical column;

biasing means comprising a pneumatic cylinder disposed between said idler pulley and said contact pulley for providing opposed biasing forces on said idler pulley assembly and said contact pulley assembly;

a grinding belt disposed around said idler pulley and said contact pulley;

a limit switch disposed to be activated when said idler pulley moves further than a selected distance from said contact pulley;

positioning means for raising and lowering said contact pulley assembly, responsive to said limit switch for raising said contact pulley assembly when said limit switch is activated;

a continuously reciprocating table disposed beneath said contact pulley assembly;

an adjustable stop for limiting movement of said contact pulley assembly toward said table; and, column drive means for continually moving said movable vertical column back and forth along an axis extending perpendicular to the movement of said reciprocating table.

15. A grinding machine as claimed in claim 1 comprising:

a reciprocating table disposed beneath said contact pulley assembly;

a second limit switch disposed to be activated each time said table reciprocates; and incremental feed means responsive to said second limit switch and connected to control said positioning means for moving said contact pulley assembly towards said table on each reciprocation of said table.

* * * * *

UNITED STATES PATENT AND TRADEMARK OFFICE

CERTIFICATE OF CORRECTION

PATENT NO. : 4,262,455

DATED : April 21, 1981

INVENTOR(S) : Richard Rettew

It is certified that error appears in the above-identified patent and that said Letters Patent are hereby corrected as shown below:

Col. 1, line 62, after "and" insert --,--;

Col. 5, line 12, delete "rmp," and substitute therefor --rpm,--;

Col. 8, line 6,, delete "C.";

Col., 9, line 41, delete the third occurrence of "switch";

Col. 9, line 63, delete "active" and substitute therefor --activate--;

Col. 11, line 59, delete "surface" and substitute therefor --surfaces--; and

Col. 16, line 9, delete "1" and substitute therefor --14--.

Signed and Sealed this

*Thirtieth* Day of *June 1981*

[SEAL]

*Attest:*

RENE D. TEGTMEYER

*Attesting Officer*

*Acting Commissioner of Patents and Trademarks*